United States Patent [19]

Arcangeli

[11] 4,314,489

[45] Feb. 9, 1982

[54] SCREWDRIVERS

[76] Inventor: Aldo Arcangeli, 132 Nelson Ave., Livingston, W. Lothian, Scotland

[21] Appl. No.: 94,741

[22] Filed: Nov. 15, 1979

[51] Int. Cl.[3] ..... B25B 15/00

[52] U.S. Cl. ..... 81/451; 81/436; 81/438

[58] Field of Search ..... 81/436, 438, 441, 451

[56] References Cited

U.S. PATENT DOCUMENTS

| | | | |
|---|---|---|---|
| 1,069,312 | 8/1913 | Zwiebel | 81/436 |
| 2,804,894 | 9/1957 | Rosenburg | 81/436 |
| 2,936,010 | 5/1960 | Ansingh | 81/436 |
| 3,289,290 | 12/1966 | Sandor | 81/436 |
| 3,424,212 | 1/1969 | Kemper | 81/436 |
| 3,891,017 | 6/1975 | Iskra | 81/436 |

FOREIGN PATENT DOCUMENTS

| | | | |
|---|---|---|---|
| 455288 | 2/1950 | Italy | 81/436 |

*Primary Examiner*—Stephen G. Kunin
*Assistant Examiner*—J. T. Zatarga
*Attorney, Agent, or Firm*—Bertram Frank

[57] ABSTRACT

A screwdriver and screw adapted so that at least one of them has a bore extending into it for receiving a pin held by the other so that in use the pin engages in the bore to hold the screwdriver and screw against lateral movement relative to one another.

1 Claim, 8 Drawing Figures

SCREWDRIVERS

This invention relates to screws and to screwdrivers for use therewith.

When using known screwdrivers and screws difficulty can be experienced firstly in accurately positioning the screw so that it is driven into the workpiece in the correct place and at the correct angle. At present such difficulties may be overcome by drilling a pilot hole which is time consuming and involves the use of additional tooling such as a bradawl or drill. Secondly, difficulty can be experienced with the screwdriver slipping out of the slot or other formation on the screw.

An object of the present invention is to obviate or mitigate the disadvantages of such known arrangements for driving screws.

According to the present invention there is provided a combination of a screwdriver and a screw, in which the screwdriver has a working end adapted to engage a head of the screw, at least one of the working end of the screwdriver and the head of the screw having a bore for receiving a pin projecting from the other, thereby in use to hold the working end of the screwdriver against lateral movement across the head of the screw.

Preferably, the pilot pin is slidably located in a bore formed in the working end of the screwdriver and is shaped, for example, tapered, at one end to facilitate insertion into a workpiece. Alternatively, however, the pin may be fixed on the screwdriver working end or on the screw.

When the screw has a bore said bore may extend axially throughout the length of the screw, in which case the pin is preferably longer than the bore, or the bore may extend through only part of the length of the screw. The bore is preferably of uniform cross-section along its length.

The screw may advantageously be in the form of a central reinforcing element having plastics material moulded around it. The plastics material may be for example polyurethane acetal, and the reinforcing element may be a core member of for example perforated tubing.

Embodiments of the present invention will now be described, by way of example, with reference to the accompanying drawings, in which.

Figure 1:
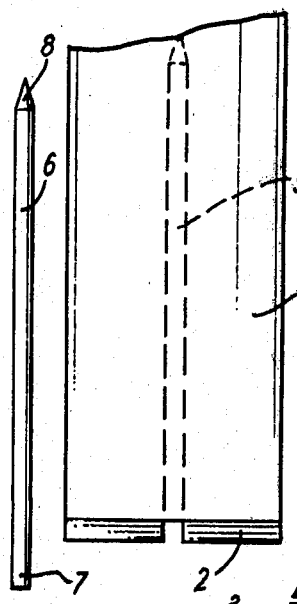
FIG. 1 shows a partial view of the screwdriver blade and associated screw and pilot pin.

Referring now to the drawings the working end of a screwdriver in the form of a blade is indicated at 1 and has a tip 2 shaped to correspond with a slot 3 of a screw 4. The blade 1 is provided with an axial cylindrical bore 5 adapted to receive a pilot pin 6 which can preferably be retained therein magnetically. The pilot pin 6 has a blunt end 7 and a sharpened end 8 and when retained in the bore 5 extends beyond the tip 2 and is adapted to co-operate with an axial bore 9 formed centrally in the head of the screw 4. Thus, when the screwdriver is driving the screw 4 the pilot pin 6 is engaged within both bores 5 and 9 to hold the blade 1 against lateral movement across the head of the screw 4 thereby to retain the screw in the desired position relative to the screwdriver. Further, if the pilot pin 6 is inserted in the bore 5 so that the pointed end 8 extends from the bore 5, the screwdriver and pin can be utilised as a bradawl.

Figure 2:
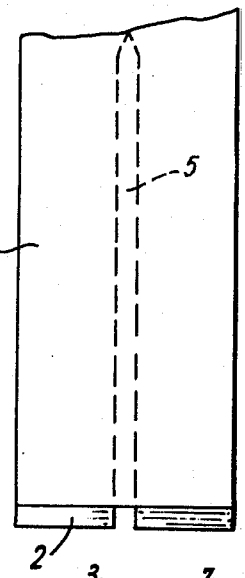
FIG. 2 shows the screwdriver and pin of FIG. 1 with a modified screw.

Referring now to FIG. 2 the screwdriver blade 1 is provided for co-operation with a screw 10 which has a slot 3 as previously described but has a parallel-sided cylindrical bore 11 extending axially throughout its length and a diameter corresponding with the diameter of the pilot pin 6. When this combination is used the pilot pin 6 is located in the bore 5 with the sharp end 8 extending beyond the tip of the blade 1 and the pin is pushed into a workpiece at a position in which the screw is to be inserted. The screwdriver is then withdrawn leaving the pin 6 inserted in the workpiece whereupon the screw 10 is slipped over the pin 6 so that the pin passes through the bore 11. The screwdriver is then slipped on the pin 6 until the tip 2 engages with the slot 3 to enable the screwdriver to drive the screw 10 into the workpiece down the pin 6. As the screw 10 moves in to the workpiece the material of the workpiece is displaced up the bore 11 pushing the pin before it and into the bore 5 of the screwdriver.

Figure 3:
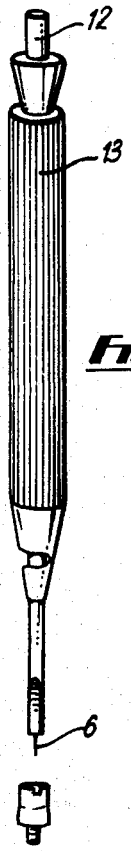
FIG. 3 shows a further screwdriver and screw of the invention.

FIG. 3 shows a watchmaker's screwdriver which operates on a similar principle to that already described except that the pilot pin is retractable into the body of the screwdriver under the control of a finger operated plunger 12 located at one end of a tubular handle 13 of the screwdriver in a manner similar to that utilised in conventional clutch pencils.

Figure 4:
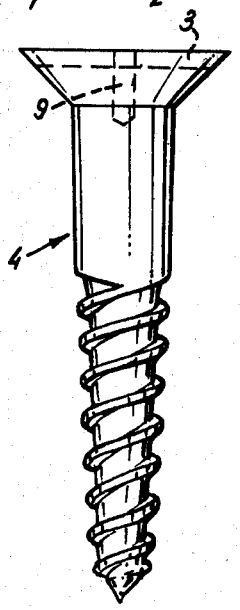
FIG. 4 shows a first attachment for a screwdriver of the present invention.
Figure 4:
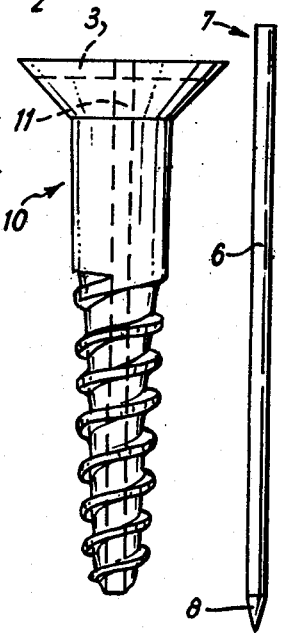
Figure 4:
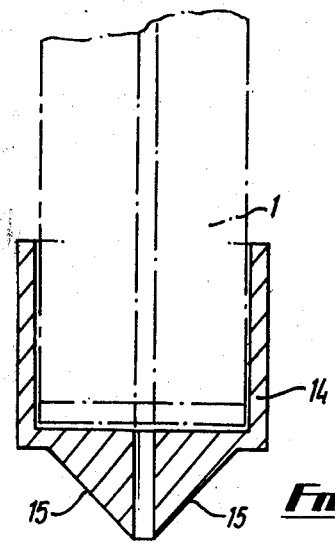

Referring now to FIG. 4 there is shown a counter sinking attachment for use on the screwdriver blade 1. The attachment includes a housing 14 shaped to fit snugly around the end of the blade 1 and having cutting edges 15 angled at the desired counter sinking angle. The counter sinking attachment has a through bore 5A through which the pin 6 projecting from the bore 5 in the blade can pass so that in operation the pin 6 is inserted in the workpiece in the manner described with reference to FIG. 2. The counter sinking attachment is slipped over the blade 1 of the screwdriver and onto the pin 6 so as to positively locate the attachment axially with the position in which the screw will eventually be inserted. Rotation of the screwdriver then enables the cutting edges 15 to cut out the countersunk portion in the workpiece. The counter sinking attachment can then be removed and the screw 10 slipped over the pin as previously described.

Figure 5:
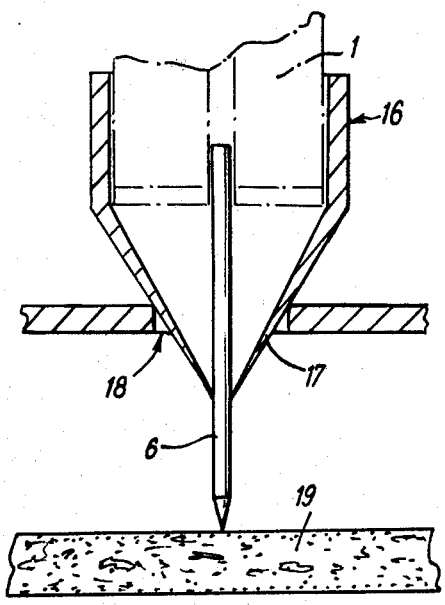
FIG. 5 shows a second attachment for a screwdriver of the present invention.

When screwing an object to a workpiece it is often necessary to align a hole in the object with the position in the workpiece into which the screw is to be driven. An attachment for facilitating this is shown in FIG. 5 and comprises a device 16 which fits over the end of the blade 1 similarly to the counter sinking attachment. The device 16 has a conical portion 17 through which the pin 6 passes concentrically and which abuts the edge of a hole 18 in the object being screwed to a workpiece 19. In use, the pin 6 is inserted into the workpiece 19 using the cone 17 as a guide so that the pin 6 is concentric with the hole 18. The screw can then be inserted in the manner previously described.

Figure 6:
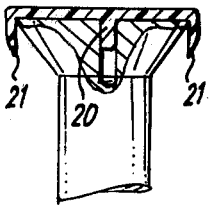
FIG. 6 shows a clip fastener for use with a screw of the invention.

If desired a clip fastener shown in FIG. 6 can be provided, having a plastics moulding of the profile shown in the drawing, the moulding fitting into the slot 3 in the screws 4 and 10. The moulding has a central lug 20 which locates in the central bore of the screw and external lugs 21 which pass over the head of the screw and, when the fastener is driven on to the screw, retain the fastener in position on the screw by deflecting under the chamfered head. The provision of such a clip fastener prevents the central bore and the slot of the screw being fouled with paint and the like and thereby facilitates removal of the screw at a later date.

Figure 7:
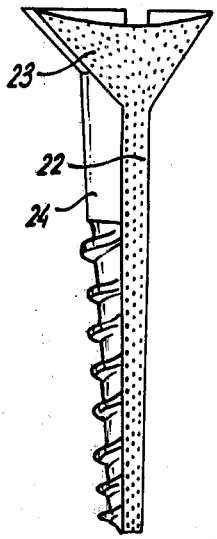
FIG. 7 shows in partial section a screw of the invention.

In FIG. 7 the construction of one particular embodiment of the screw of this invention is shown. The screw has a central rigid strengthening portion 22 of metal, in the form of a cylindrical tube terminating in flared upper portion 23. The tube defines the through bore for the screw. Around the central portion 22 is moulded a polyurethane acetal body 24 into the desired final shape of the screw.

Figure 8:
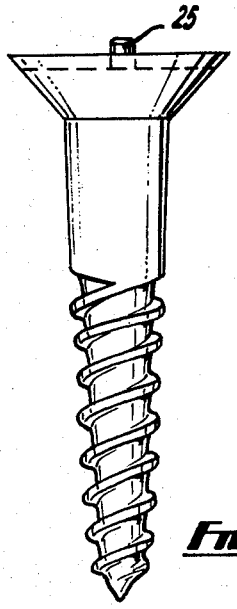
FIG. 8 shows a further form of a screw of the invention.

FIG. 8 shows a modification of the screw in which a short fixed pin 25 exends upwardly from the head of the screw for engagement in the bore of the screwdriver blade.

While in the above described embodiments the pilot pin has been shown as being concentric with the axis of the screwdriver clearly the pin could be provided at a position offset from the centre or to one side of the screwdriver blade as desired. Furthermore, the pin can either be a short pilot pin extending into the bore in the screwdriver or it may pass throughout the length of the screwdriver as in the embodiment shown in FIG. 3.

Other improvements or modifications may be made without departing from the scope of the invention.

I claim:

1. In combination, a screwdriver, a screw and a pin, in which the screwdriver has a working end adapted to engage a head of the screw, the screwdriver and screw each having bore means for slidably receiving the pin whereby in use the working end of the screwdriver is held against lateral movement across the head of the screw and wherein the pin extends through the screw and moves upwardly into the screwdriver as the screw penetrates a workpiece.

* * * * *